United States Patent [19]

Joseph

[11] Patent Number: 4,707,107

[45] Date of Patent: Nov. 17, 1987

[54] ELECTROPHOTOGRAPHIC DEVELOPMENT APPARATUS WITH AN IMPROVED RIBBON BLENDER

[75] Inventor: Brian J. Joseph, Rochester, N.Y.

[73] Assignee: Eastman Kodak Company, Rochester, N.Y.

[21] Appl. No.: 935,877

[22] Filed: Nov. 28, 1986

[51] Int. Cl.[4] ..... G03G 15/00

[52] U.S. Cl. ..... 355/3 DD; 355/14 D; 366/320

[58] Field of Search ..... 366/320; 355/3 DD, 14 D

[56] References Cited

U.S. PATENT DOCUMENTS

| | | | |
|---|---|---|---|
| 4,131,357 | 12/1978 | Forbes | 355/3 DD |
| 4,154,372 | 5/1979 | Ricciardi | 366/320 |
| 4,610,068 | 9/1986 | Schultz | 366/320 |
| 4,634,286 | 1/1987 | Pike | 366/320 |

FOREIGN PATENT DOCUMENTS 0160830 11/1985 European Pat. Off. .

*Primary Examiner*—Patrick R. Salce

*Assistant Examiner*—Judson H. Jones

*Attorney, Agent, or Firm*—G. Herman Childress

[57] ABSTRACT

An electrographic development apparatus has a sump for receiving developer material including carrier particles and toner particles. A ribbon blender in the sump mixes the toner particles and carrier particles, circulates them within the sump and assists in transporting of the materials to a magnetic brush where the toner particles can be transferred to an electrostatic image on a photoconductor. The improved ribbon blender has an elongate helical ribbon positioned within the sump and extends along the sump with adjacent convolutions of the ribbon being spaced from each other. A plurality of buckets are secured to the ribbon between adjacent convolutions of the ribbon. The buckets on one convolution of the ribbon are spaced from the buckets on adjacent convolutions of the ribbon. The buckets can be open radially outwardly relative to the axis of rotation of the ribbon blender, and additional buckets can face radially inwardly to enhance mixing of developer material by picking up the material and transporting it axially and then dropping it near the blender's center line.

4 Claims, 6 Drawing Figures

ELECTROPHOTOGRAPHIC DEVELOPMENT APPARATUS WITH AN IMPROVED RIBBON BLENDER

BACKGROUND OF THE INVENTION

This invention relates to electrographic development apparatus having an improved ribbon blender for mixing developer material in a sump by providing feed members on a ribbon of the blender.

Commonly-assigned copending U.S. patent application Ser. No. 597 323, filed Apr. 6, 1984 in the names of Brian J. Joseph and Thomas K. Hilbert discloses an electrographic copier having a development station with a sump. Located within the sump is a ribbon blender that circulates developer material comprising carrier particles and toner particles axially within the sump to agitate and shear the developer material, promote tribocharging, and feed the developer out of the sump along a path that leads to a magnetic brush. In one embodiment of the apparatus disclosed in that application feeder vanes spaced radially outwardly from the blender pick up developer material in the sump and feed it from the sump directly to a magnetic brush located above the ribbon blender. The feeder vanes are spaced about the circumference of the ribbon blender, and each vane extends continuously from one end portion of the ribbon blender toward the other end thereof and above the convolutions of the ribbon blender. Such apparatus works well; however, if the cohesivity of the developer material is high, the feeder vanes tend to bore out a hole of cylindrical configuration in the developer material and the feeder vanes begin to trowell out the material around the circumference of that cylinder. Such can leave an area of developer material in the bottom of the sump that is not mixed and moved with the other developer material, resulting in packing of the developer material between the feeder vanes and the walls of the sump. This packed material connot be used for its intended purpose of developing images on the photoconductor and may have other adverse effects on the apparatus.

SUMMARY OF THE INVENTION

Accordingly, it is an object of the invention to provide an improved development station for electrographic apparatus which avoids the tendency to bore out a hole and form a tunnel in the sump of development apparatus as described above. Another object of the invention is to provide for enhanced mixing of developer material in the sump and transporting such material axially toward the center line of the blender.

In accordance with the present invention a development station of an electrographic apparatus has an elongate sump for receiving a supply of developer material and a ribbon blender for mixing the material in the sump. The ribbon blender is rotatable about an axis and has an elongate helical ribbon positioned within the sump and having a plurality of convolutions axially spaced along the sump. The improvement of the invention comprises a plurality of feed members adjacent the ribbon and extending generally axially relative to the ribbon. The feed members are spaced from each other along the ribbon and are spaced from feed members on adjacent convolutions of the ribbon.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
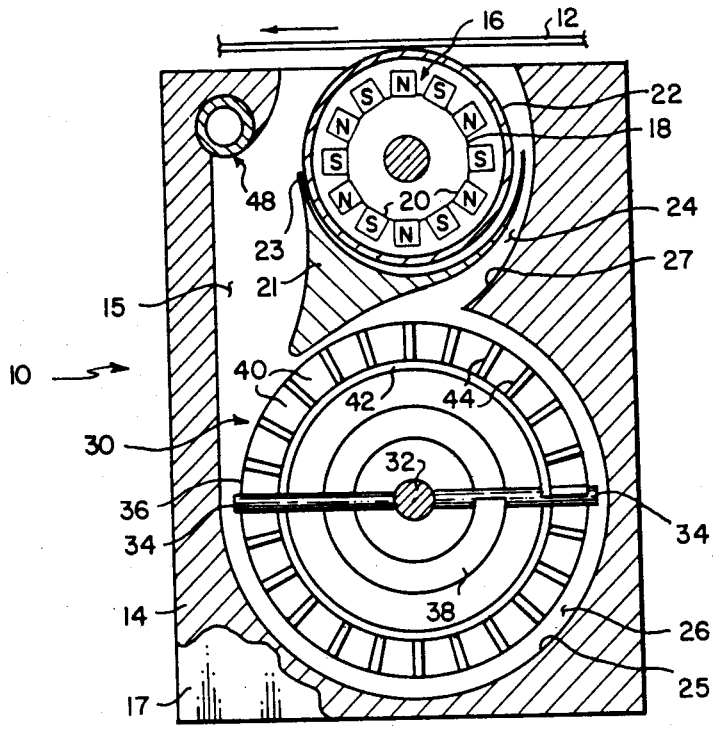
FIG. 1 is an end view of one preferred embodiment of development apparatus of the present invention.

Referring now to FIG. 1 of the drawings, a development station for electrographic apparatus of the present invention is generally designated 10 and is adapted to provide a supply of marking particles, such as toner, to an electrostatic image formed on a photoconductor 12 of electrographic apparatus to develop the image. The photoconductor is moved along a path leading past the apparatus 10 in the direction shown by the arrow during operation of the electrographic apparatus.

The development apparatus 10 has an elongate housing 14 with end walls 15 and 17. A magnetic brush 16 located in the upper portion of housing 14 extends substantially the entire length of the housing and is closely adjacent to the path of the photoconductor 12. The magnetic brush preferably comprises a core 18 and a series of permanent magnets 20 concentrically arranged around the core 18. The core and magnets are rotatable about the axis of the core in a clockwise direction as viewed in FIG. 1 by a motor (not shown). Magnets 20 are arranged so that the poles at the outer portions thereof are alternately north and south poles as indicated in the drawings. Concentric with the core 18 and magnets 20 is a cylindrical, non-magnetic shell 22. The lower portion of the shell is adjacent a wiper block 21, and the upper portion of the shell is adjacent the photoconductor 12. The shell is driven in a counterclockwise direction by suitable means (not shown). The magnets 20 attract developer material to the shell, and the rotation of the core and shell bring such material in a counterclockwise direction into contact with the lower or insulating surface of the photoconductor 12 in a conventional manner.

A blade-like wiper 23 on the wiper block 21 removes developer material from shell 22 after such material has been carried past the area of contact with the photoconductor. The wiper block separates the lower part of the brush from the bottom of housing 14. Developer is delivered to the brush through a passageway 24 between the wiper block and a wall 27 of the housing.

A generally cylindrical wall 25 in the lower portion of housing 14 beneath magnetic brush 16 forms a sump 26 that receives a supply of developer material. The developer material may comprise a mixture of carrier particles and toner particles, including developer material comprising hard carrier particles of permanent magnetic material and toner particles as disclosed in commonly assigned U.S. Pat. No. 4,546,060, issued Oct. 8, 1985 in the names of E. T. Miskinis et al.

A ribbon blender generally designated 30 is positioned within the sump 26 with the lower portion thereof being adjacent the cylindrical wall 25 of the housing. Blender 30 comprises a shaft 32 mounted for rotation about its axis in a generally counterclockwise direction as viewed in FIG. 1. A plurality of rods 34 project radially outwardly from the shaft 32 with adjacent rods being offset axially along the shaft and projecting in substantially diametrically opposite directions.

An outer spiral ribbon 36 extends in a helical manner along shaft 32. Each part of ribbon 36 is substantially equally spaced from the shaft 32. An inner ribbon 38 also is secured to rods 34 and extends along the shaft 32 and for substantially the same distance as the ribbon 36. The inner ribbon 38 is smaller in diameter than the outer ribbon 36, and the inner ribbon also has a pitch that is opposite to the pitch of the ribbon 36. Adjacent convolutions of each ribbon are spaced from each other in an axial direction. Upon rotation of shaft 32 in one direction, the outer ribbon tends to move the developer material in one direction and the inner ribbon tends to move the developer material in the opposite direction.

Figure 2:
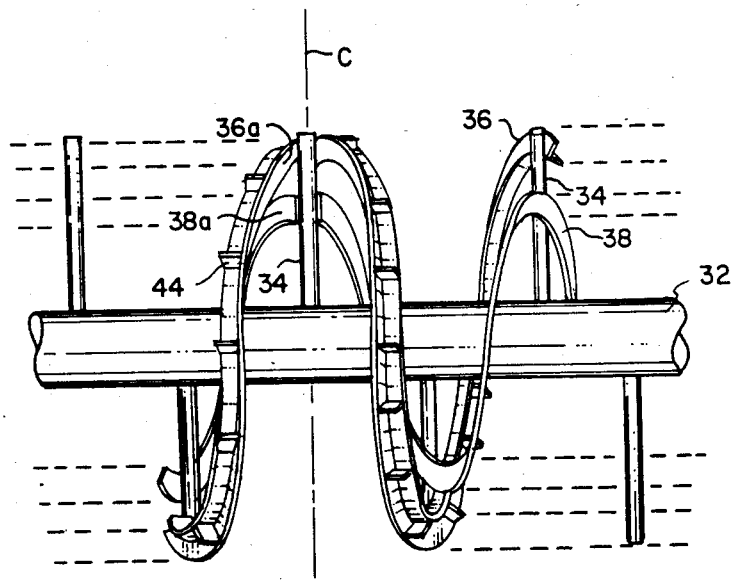
FIG. 2 is a fragmentary elevation view of a portion of the ribbon blender of the development apparatus.
Figure 3:
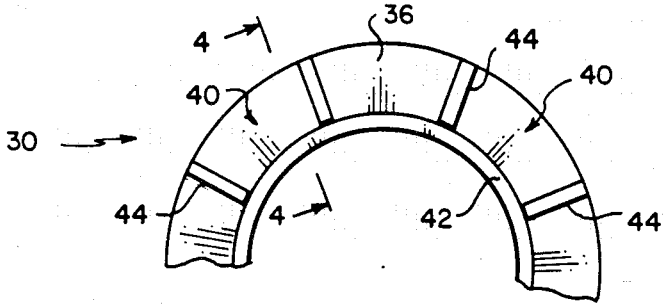
FIG. 3 is an enlarged fragmentary view of one convolution of the ribbon blender.
Figure 4:
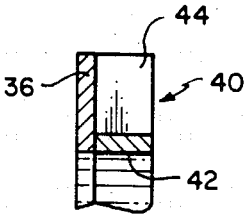
FIG. 4 is a fragmentary cross-section view taken along line 4—4 of FIG. 3.

Ribbons 36, 38 can extend continuously for the full length of the blender. Alternatively, as shown in FIG. 2, ribbons 36, 38 can extend along one end portion of shaft 32 while similar ribbons 36A, 38A having the opposite pitch can extend along a second end portion of the shaft. More specifically, ribbons 36A, 38A can extend from adjacent a second end of the shaft 32 to a position near the center line C of the blender and adjacent the ends of the ribbons 36, 38. Ribbon 36A is substantially the same as ribbon 36 but is positioned around shaft 32 so that the pitch of ribbon 36A is opposite in direction to the pitch of ribbon 36. Similarly, ribbon 38A is similar to ribbon 38 but is positioned around the shaft 32 so that its pitch is opposite in direction to the ribbon 38. Also, the pitch of ribbon 36A is opposite in direction to the pitch of ribbon 38A. Thus when shaft 32 is rotated in one direction, for example in a counterclockwise direction as viewed from the right end of the shaft in FIG. 2, the outer ribbons 36 and 36A tend to move developer material along a generally cylindrical path toward the center of blender 10. Simultaneously, inner ribbons 38 and 38A tend to move developer material in a generally cylindrical path from the center of blender 10 toward the ends thereof. Shaft 32 could, of course, be rotated in the opposite direction in which case the outer ribbons would tend to move developer material toward the ends of the shaft and the inner ribbons would tend to move developer toward the center of the shaft.

In accordance with the present invention, improved feed means are provided for delivering developer material from sump 26 to the magnetic brush 16. The feed means shown in FIGS. 1–4 comprise a plurality of buckets generally designated 40 located adjacent the outer ribbon 36 of the ribbon blender and between adjacent convolutions of ribbon 36. Buckets 40 are formed by a helical wall 42 and a plurality of partitions 44. Wall 42 projects in an axial direction from the radially inner end of the outer ribbon 36 of the ribbon blender. Wall 42 can be secured to ribbon 36 or mounted to be adjacent thereto. Partitions 44 project radially outwardly from wall 42 and are equally spaced along wall 42. The radially outer edge of each partition 44 is substantially aligned with the outer edge of ribbon 36.

The buckets 40 defined by wall 42 and partitions 44 are partly closed by the ribbon 36, wall 42 and partitions 44 but open radially outwardly and at the side opposite ribbon 36. This allows developer material to be forced into the buckets as they sweep through the lower portion of the sump 26 and move upwardly toward the top of the ribbon blender as viewed in FIG. 1. At that point the developer material in the buckets 40 falls under the influence of the magnetic force from the magnets 20 of the brush 16 and thus are attracted toward the lower surface of the wiper block 21. In addition, rotation of the buckets produces a centrifugal force tending to feed the developer material out of the buckets 40 and toward the passageway 24 where it is advanced by rotation of the magnets 20 through the passageway and onto the surface of the shell 22. The amount of material flowing through passageway 24 is limited by the spacing between the wiper block and wall 27, and excess material moves downwardly under the force of gravity back into the buckets and between adjacent convolutions of the ribbon blender into the sump 26.

During operation shaft 32 of the ribbon blender and shell 22 of the magnetic brush are driven in counterclockwise directions as viewed in FIG. 1 of the drawings. As the ribbon blender is rotated the outer and inner ribbons 36, 38 are effective to move developer material in sump 26 axially through the sump and along the sump in different directions to provide the desired triboelectric mixing of the developer material as described in more detail in the before-mentioned copending U.S. patent application Ser. No. 697,323. The buckets 40 pick up developer material during rotation of the ribbon blender and feed that material to passageway 24 between the wiper block 21 and wall 27.

Material thus fed into the passageway 24 is driven through that passageway by the magnetic force from magnets 20 of the magnetic brush to bring the material to the shell 22. The developer material then travels counterclockwise with the shell and into a development zone at the top of brush 16 where toner particles from the material can be transferred to photoconductor 12 to develop the latent image on the photoconductor. Any developer material remaining on the shell after it passes the development zone is removed by the wiper 23. Removed developer material then slides along the left side of the wiper block 21 as viewed in FIG. 1 and is returned to the sump.

Since some of the toner particles are depleted from the developer mix during operation, fresh toner can be added by a toner dispenser 48 shown in the upper left portion of the housing in FIG. 1. This location of the toner dispenser is desirable since it allows the fresh toner to be dropped directly into the sump where it can be mixed with used developer mix being returned to the sump. In addition, this location of the toner replenisher is spaced well above the ribbon blender and buckets 40 where it is not likely to be blocked by developer material being transported by the ribbon blender and the magnetic brush.

Figure 6:
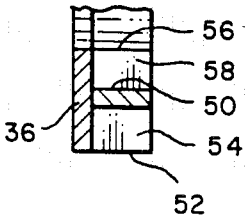
FIG. 6 is a cross-section view taken along lines 6—6 of FIG. 5.
Figure 5:
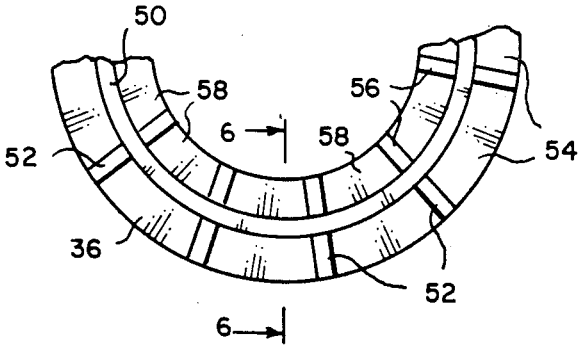
FIG. 5 is a view similar to FIG. 3 showing a modification of the ribbon blender.

FIGS. 5 and 6 of the drawings illustrate another embodiment of the feed members. In this embodiment a helical wall 50, similar to wall 42, is secured to the outer ribbon 36 of the ribbon blender approximately midway between the radially inner and outer edges of the ribbon. Wall 50, together with a plurality of partitions 52, form buckets 54 for feeding developer material into the passageway 24 as explained hereinbefore. Partitions 54 project radially outwardly from the wall 50 in the same manner as partitions 44. In addition, a second group of partitions 54 are secured to wall 50 and project radially inwardly from wall 50 toward the shaft 32 of the ribbon blender. Partitions 56, wall 50, and the radially inward portion of ribbon 36 define a plurality of buckets 58 which receive developer material as the buckets 58 pass through the bottom of sump 26. Material received in buckets 58 will be lifted from the bottom of the sump during rotation of the ribbon blender and fall back into the sump generally in the area of the shaft 32, i.e., along the axially center portion of the ribbon blender or sump, as the buckets 58 travel above the shaft 32. This action complements and enhances the mixing ability of the ribbon blender. While the number of partitions 56 shown in FIG. 5 is equal to the number of partitions 52, it will be understood that there can be more or fewer partitions 56, as desired, in order to accomplish the desired mixing and feeding of developer material.

In the preceding description the buckets 40, 54 and 58 have been described relative to ribbon 36. Similar buckets also are provided on ribbon 36A. The buckets also could be provided on ribbons 38, 38A, if desired.

The invention has been described in detail with particular reference to preferred embodiments thereof, but it will be understood that variations and modifications can be effected within the spirit and scope of the invention as described hereinabove and defined in the appended claims.

I claim:

1. In a development station of an electrographic apparatus having a sump for receiving a supply of developer material and a ribbon blender for mixing the material in the sump, the ribbon blender being rotatable about an axis and having an elongate helical ribbon positioned within the sump and having a plurality of convolutions axially spaced along the sump, the improvement comprising:

a plurality of feed members adjacent the ribbon and extending generally axially relative to the ribbon, the feed members being spaced from each other along the ribbon and being spaced from feed members on adjacent convolutions of the ribbon.

2. In a development station of an electrographic apparatus having an elongate sump for receiving a supply of developer material and a magnetic brush for applying developer material to a photoconductor, a ribbon blender for mixing the material in the sump, the ribbon blender being rotatable about an axis and having an elongate helical ribbon positioned at least partially within the sump and extending along the sump, the ribbon having a plurality of convolutions spaced from each other along the axis, the improvement comprising:

a wall secured to the ribbon, and extending generally axially from the ribbon, a plurality of partitions engaging the wall and the ribbon to form therewith buckets for picking up developer material in the sump and delivering such material to the magnetic brush.

3. The improvement as set forth in claim 2, wherein the partitions project radially outwardly from the wall and are spaced from each other along the wall.

4. The improvement as set forth in claim 3 wherein some of the partitions project radially outwardly from the wall and other of the partitions project radially inwardly from the wall to thereby form buckets on both sides of the wall.

* * * * *